US005149191A

United States Patent [19]

Lewin et al.

[11] Patent Number: 5,149,191

[45] Date of Patent: Sep. 22, 1992

[54] COMBINATION LOUVER/LENS LIGHT FIXTURE SHIELD

[76] Inventors: Ian Lewin, 11408 St. Andrew's Way, Scottsdale, Ariz. 85254; Joe Greer, 4827 N. 35th St., Phoenix, Ariz. 85018

[21] Appl. No.: 812,028

[22] Filed: Dec. 23, 1991

[51] Int. Cl.[5] ..... F21V 11/02

[52] U.S. Cl. ..... 362/290; 362/354

[58] Field of Search ..... 362/290, 292, 354

[56] References Cited

U.S. PATENT DOCUMENTS 3,093,323 6/1963 Guth .
3,152,277 10/1964 Cutler et al. .
3,725,697 4/1973 Wince .
4,233,651 11/1980 Fabbri .
4,613,929 9/1986 Totten ..... 362/354 X
4,630,181 12/1986 Fain et al. ..... 362/290 X
4,644,454 2/1987 Herst et al. .
4,644,455 2/1987 Inglis et al. .
4,816,976 3/1989 Fouke et al. .

*Primary Examiner*—Allen M. Ostrager
*Attorney, Agent, or Firm*—LaValle D. Ptak

[57] ABSTRACT

A louver/lens assembly for placement in the light-emitting opening of a fluorescent light luminaire has a louver assembly mounted in the light-emitting opening of the luminaire. On top of the louver assembly, and between it and the fluorescent tubes, a prism lens, typically formed from a sheet of extruded transparent acrylic material, is placed. The lens sheet is flat on the surface facing the fluorescent tubes in the fixture, and has parallel longitudinal prisms formed in the surface overlying the louver assembly. The prisms are selected to direct light rays passing through the lens assembly downwardly through the openings between the longitudinal and transverse louvers of the louver assembly.

19 Claims, 4 Drawing Sheets

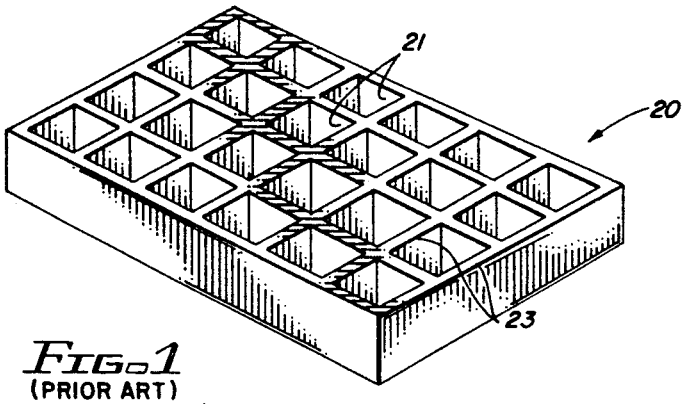
FIG. 1
(PRIOR ART)
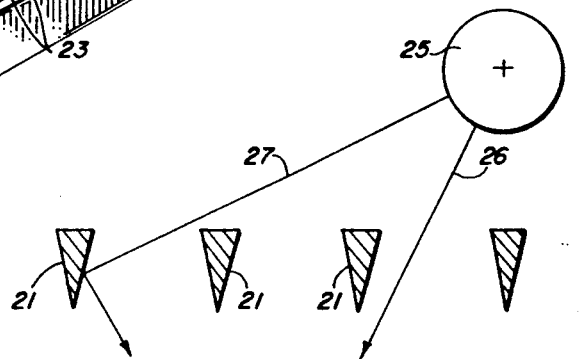
FIG. 2
(PRIOR ART)
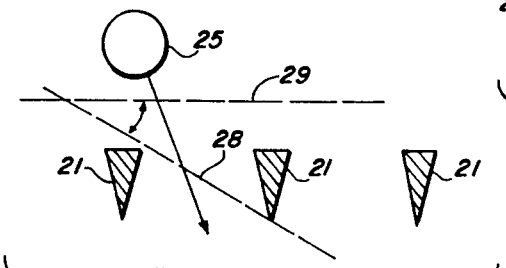
FIG. 3
FIG. 4
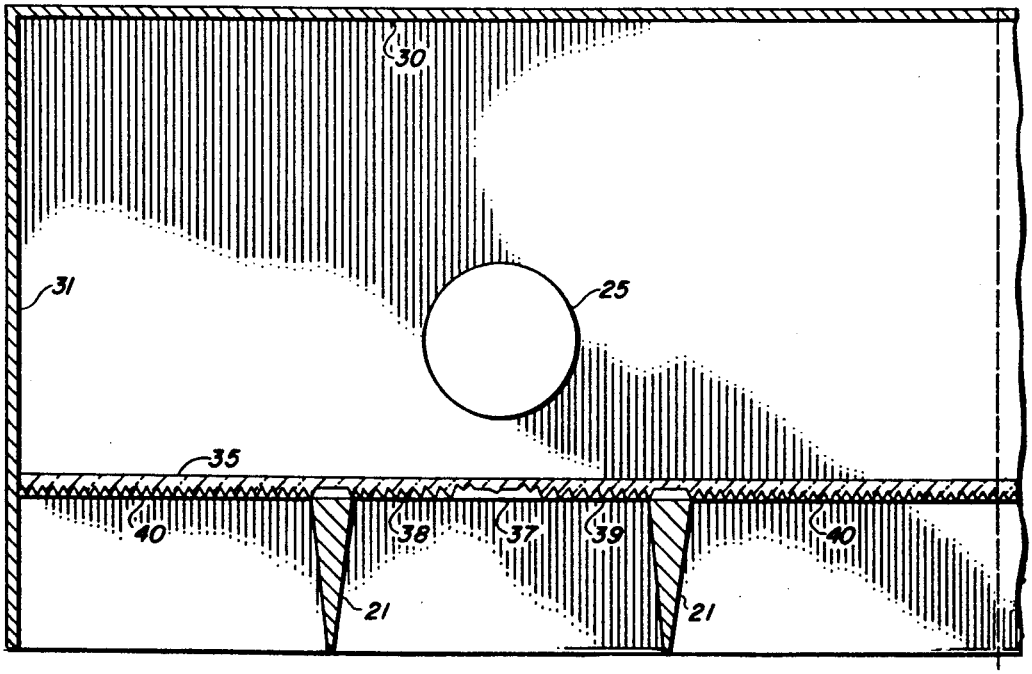

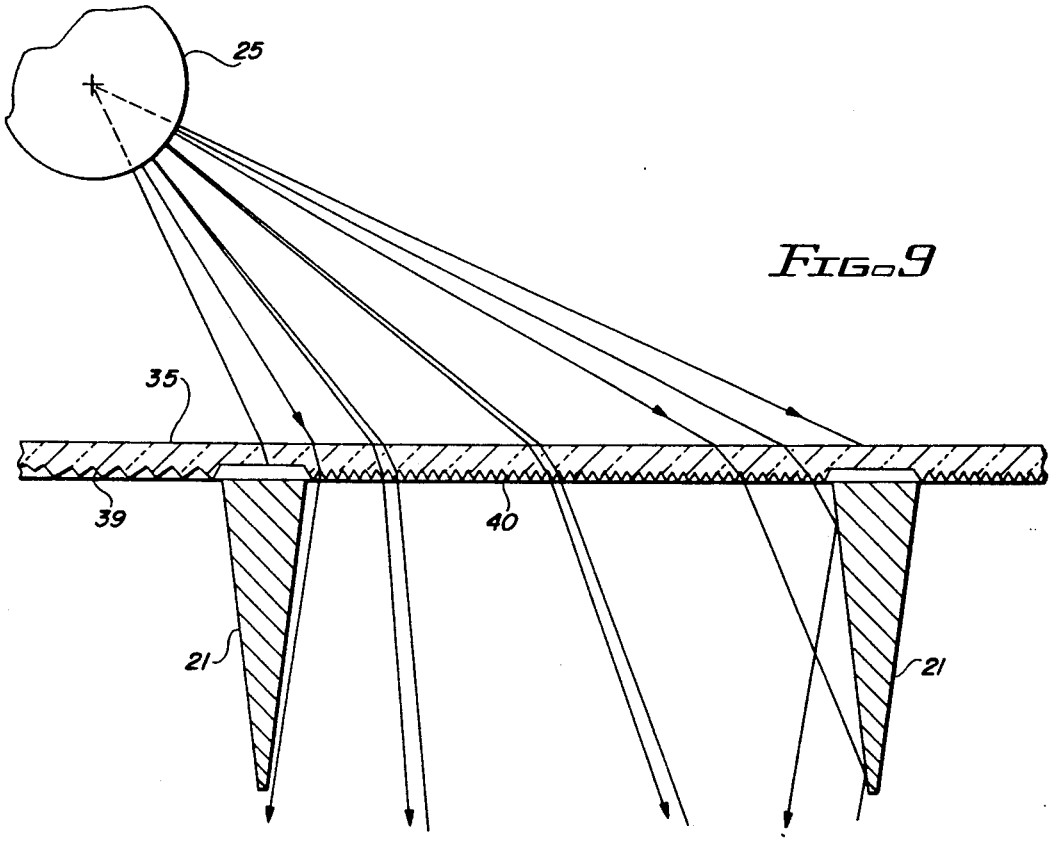
FIG. 9
FIG. 10
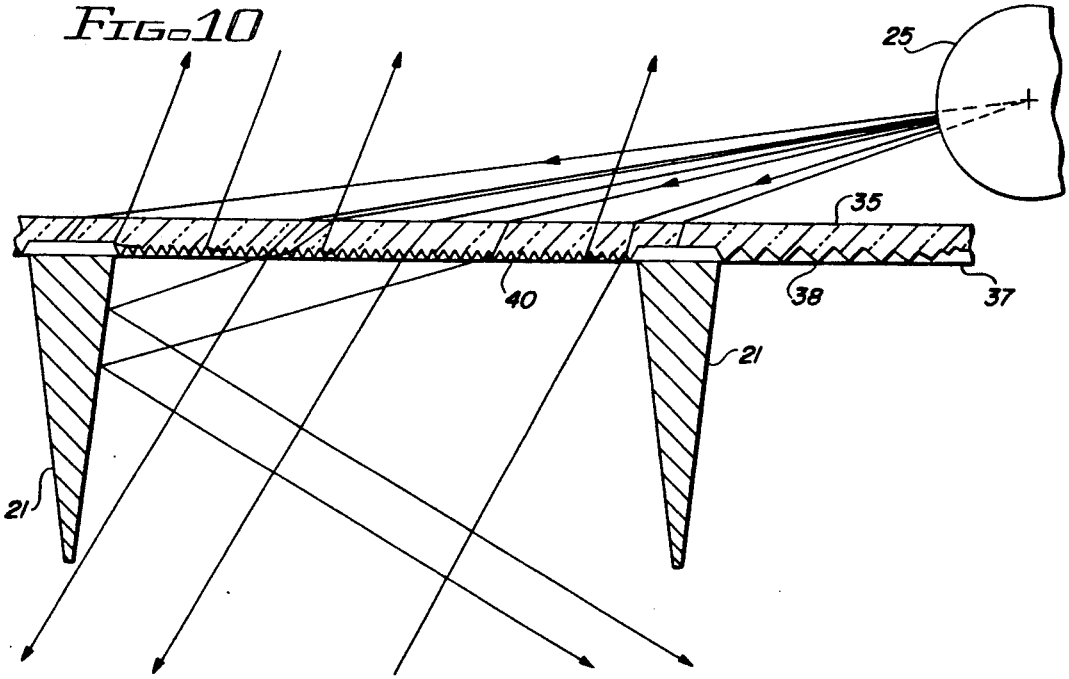

COMBINATION LOUVER/LENS LIGHT FIXTURE SHIELD

BACKGROUND

Ceiling luminaires of the type widely used in commercial installations normally consist of a fixture or housing into which one or more lamps may be mounted, along with appropriate electrical connections. The lamps may of a variety of different types, such as incandescent, high-intensity gas discharge, or fluorescent lamps. For commercial installations, elongated fluorescent lamp tubes currently are the most popular. Frequently, some form of a shielding medium is used in the light-emitting opening or aperture of the fixture to direct the light rays into preferred directions. This is done for a number of purposes, such as reducing glare, to hide the appearance of the lamps, or to direct the light rays toward objects to be lighted. Consequently, there may be aesthetic benefits, the creation of increased visibility, and an associated reduction in the total amount of energy consumed by the lighting system.

Shielding media also may of a variety of different forms; but such media usually are in one or the other of two categories, namely, reflecting or transmitting. A popular example of a reflecting medium is a louver assembly. Louver assemblies typically consist of vertical or slightly curved blades arranged in a generally vertical orientation in the opening of the luminaire housing. These blades are arranged in a pattern, generally in the form of longitudinal and transverse louvers, to form a number of apertures through which the light passes. The louver blades are typically formed of metal or metalized plastic; so that light rays striking a louver blade are reflected in a generally downward direction.

Louver assemblies have become very popular because of their ability to significantly reduce or eliminate glare, which otherwise would be seen by a viewer looking at the lighting fixture at angles close to horizontal, for example, from 50° to 90° from the downward vertical. Louvers formed from metal or employing metalized plastic blades which have a slight curvature to the blade surface are widely used. These louvers intercept light rays traveling at high angles from nadir, and redirect such light rays to lower angles Rays which are emitted from the lamps within the fixture at lower vicinity of the lighting fixture, rather than traveling across the space to be viewed as glare. Rays which are emitted from the lamp in the fixture at low angles (near vertical) pass through the louver apertures uninterrupted.

When louver assemblies are constructed from highly reflective material, they are generally efficient, that is, the total lumen output of a fixture equipped with such a louver assembly as a percentage of the total lumens generated by the lamp is fairly high. Louver assemblies, however, have three major disadvantages. One disadvantage relates to the appearance of louvered fixtures in general. A second disadvantage is connected with the width of the overall light pattern produced by the louvers and their associated luminous efficiency. A third disadvantage concerns the appearance of the actual louver blades in the louver assembly.

The first of the disadvantages of louver assembly concerns the "shielding angle" of such assemblies. The shielding angle is determined by the closeness of the spacing of the louver blades and their vertical width or depth. If a viewer looks up toward the lighting fixture such that his line of sight makes an angle with horizontal which is less than the shielding angle, an attractive appearance of the fixture is presented to the viewer. If a viewer however, looks up at the lighting fixture such that his line or sight makes a greater angle to the horizontal than the shielding angle, the viewer then has a clear view of the bright light source and the various electrical and hardware items located inside the fixture. From an architectural standpoint, this is undesirable and it is aesthetically unattractive. If a viewer happens to look up into a fixture, the viewer also is subjected to glare from the direct observation of the lamps within the fixture.

This appearance problem of louver assemblies can be improved somewhat by increasing the shielding angle. This may be accomplished in one of two ways, the first of which is to reduce the distance of separation between the longitudinal and transverse louver blades. Doing this, however, creates another disadvantage. Densely spaced blades cause a greater proportion of the light rays to be intercepted, rather than passed freely through the apertures in the louver assembly. A typical blade reflectance of 85 percent thus creates an absorption of 15 percent of any light rays striking the blade An increase of the total wattage of the lighting system then is needed to maintain a required level of work surface illumination. Because of widespread current concerns of energy conservation, the trend within the lighting industry is to reverse this effect by using larger aperture sizes in a louver assembly for the lighting of general spaces, rather than using smaller aperture sizes.

The shielding angle also can be increased by extending the vertical depth of the louver blades in the louver assembly. The same problem of causing a greater proportion of light rays to be intercepted, rather than passed freely through the apertures exists when this approach is taken. In addition, another problem is presented from an architectural or structural standpoint as much as the deeper blades require a fixture having greater vertical depth; so that the blades either extend below the ceiling line or greater space above the ceiling line is required for the fixture.

When closer louver blade spacing is used to increase the shielding angle, another problem is introduced inasmuch as a greater proportion of blade tops, or horizontal upper areas of the blades, exists. These blade tops intercept light and do not redirect the light into usable directions. Consequently, the luminous efficiency of the fixture is reduced; and the power necessary to achieve any given lighting level must be increased.

The second problem or disadvantage of louvered light fixtures concerns the width of the overall light pattern produced by the louvers, and the associated efficiency mentioned above. The direction of any ray of light from the light source within the fixture is affected by the angle of the louver blade at the point of interception.

The blade depth is maintained constant (typically, in a range from 0.5" to 4"), a decrease in the radius of curvature of the blade at any or all points along its profile causes the width or the horizontal top of the louver blade to increase. This radius decrease lowers the angle of the reflected ray, but an increased top surface area of the louver blades of the assembly decreases the luminous efficiency of the fixture. Consequently, a louver assembly designed to be highly concentrating, that is, producing a strong downward disposition of light rays close to nadir, will have low efficiency. As mentioned above, most louver assemblies have blades which run both longitudinally and transversely of the fluorescent tube in the fixture to form square or rectangular openings or apertures through which the light passes. Consequently, the effect of an increased top width of the louver blades is multiplicative, and rapidly reduces the open top area of the apertures. This results in a relatively low efficiency from light concentrating louvers. Frequently, such louvers absorb more light than is emitted through the fixture, that is, fixture efficiency is less than fifty percent (50%).

In spite of the very low efficiency and associated energy penalty, concentrating louver assemblies are widely used in commercial installations. This is, in large part, a result of the widespread use of electronic devices which incorporate video display units (VDU's). Lighting for areas which contain such VDU's typically is recommended to be obtained from highly concentrating fixtures to minimize reflection of light from the fixtures to the VDU screens and back into the eyes of the operators. For example a fixture which produces medium spread or wide spreading of the rays of light from the fixture, allows light to fall on the VDU screen and reflect into the eyes of the operator, who may need to operate such a VDU terminal for prolonged periods of time. This is considered a serious problem by engineers, architects, management health, union and government authorities. Concentrating fixtures which produce rays clustered close to nadir, either do not have rays which strike the VDU screen at all, or, when they do, they are reflected in a generally downward direction away from the operator's eyes. This produces a visibility increase and a freedom from reflected glare, with an associated reduction in visual error and eye fatigue.

A third disadvantage of louver blade assemblies concerns the appearance of reflected light in the louver blades themselves. If the louver blades are manufactured with highly specular surfaces (to provide maximum efficiency), there is an appearance within the louver when it is viewed from certain angles (typically, close to the shielding angle), of very dark and very bright areas in close proximity. Even on an individual louver blade, part of the blade will be lighted brightly by the reflected image of a lamp in the fixture, while another part, because of an angular change, is not positioned to reflect an image and appears nearly black. This produces a displeasing appearance, and creates, in effect, many small areas of reflected glare which are emphasized in appearance by being adjacent the dark or black areas. Typically, this problem is addressed by manufacturers to produce the louver blades from a satin finish or semi diffuse aluminum. Such materials tend to smooth out or diffuse the localized patches of glare by their inherent properties of diffusion. While this is desirable from an appearance standpoint, the accuracy of the light control is reduced; and scattered light rays are introduced. The precision or the light pattern, therefore, is lost. The total elimination or brightness or glare at high angles disappears. In addition, the efficiency of the fixture is reduced by several percent, due to the multiple interreflections of the diffused portions of the light rays as they bounce between the louver blades forming each of the apertures.

An approach to solving at least one of these problems, the problem of a clear view of the interior of the fixture through the louvers at high angles of view, is addressed by the patent to Fain No. 4,630,181. Fain has a louver assembly which employs a translucent light-diffusing panel on top of the louvers. This panel is located between the louvers and the lamps within the fixture, and functions to provide standard diffusion of the light emanating from the fixture. Reduction in efficiency of the assembly, directly attributable to the translucent diffusing panel, is introduced; and because of the inherent characteristics of such a panel, increased scattering of light rays also occurs. The multiple interreflections of light rays passing through the diffuser panel and striking the louver blades also result in reduced efficiency. Some of the precision of the light pattern is lost; so that brightness elimination at high angles of view no longer occurs. Thus, while Fain attempts to solve one of the problems mentioned above concerning louver assemblies, the effort to solve that problem results in the additional disadvantages mentioned.

Two patents which are directed to variations of louver assemblies for the light-emitting opening of fluorescent lamp fixtures are the patents to Guth No. 3,093,323 and Cutler No. 3,152,277. The patent to Guth uses a prismatic light diffuser panel having longitudinally extending and transversely extending upwardly facing prisms, with smaller prisms formed in the surface of the diffuser which faces the interior of the room. No glare reducing louver assembly is suggested or disclosed in this patent.

The Cutler patent also is directed to a lens made in the form of individual glass lenses located in each of the louver apertures, to extend the image of the lamp through the louvers. Each of the lenses are the same throughout the fixture; and they are formed as an integral part of a specially constructed fluorescent lamp structure. The fixture of Cutler does not use standard fluorescent tubes, and is not designed to be used with such standard tubes.

The patent to Lewin No. 3,988,609 is directed to a high-efficiency wide light distribution panel. The panel includes three bands of prismatic elements, uniformly spaced across the panel an separated by substantially transparent bands with shallow flutes in them to soften the lamp images. Other prisms are included for increasing the spread of light to the sides of the fixture. This is not a fixture using a louver assembly; but it is one which is designed to even out the spread of light from the fixture over the area being illuminated.

It is desirable to provide a louver assembly for a light fixture which overcomes the disadvantages mentioned above with maximum efficiency, and which is aesthetically pleasing in appearance and easy to install.

SUMMARY OF THE INVENTION

It is an object of this invention to provide an improved lighting fixture assembly.

It is another object of this invention to provide an improved louver assembly for fluorescent light fixtures.

It is an additional object of this invention to provide an improved efficiency louver assembly for fluorescent light fixtures.

It is a further object of this invention to provide a combination louver/lens assembly for use with fluorescent light fixtures In accordance with a preferred embodiment of this invention, a light-shielding and light-directing apparatus is provided for placement in the light-emitting opening of a luminaire which has a source of light in it. The apparatus includes a louver assembly, which is mounted in the opening of the luminaire, and which comprises a plurality of longitudinal and transverse louvers dividing the light-emitting opening into a plurality of rectangular apertures. A lens is placed in the luminaire between the louver assembly and the source of light to intercept rays from the source of light in the luminaire, and to direct such intercepted light downwardly through the apertures in the louver assembly at angles selected to minimize the amount of light which strikes the louvers of the louver assembly.

BRIEF DESCRIPTION OF THE DRAWINGS

FIG. 1 is a perspective view of a typical prior art louver assembly;

FIGS. 2 and 3 are diagrammatic representations useful in explaining the operation of the louver assembly of FIG. 1;

FIG. 4 is a cross-sectional view of a preferred embodiment of the invention;

FIGS. 7, 8, 9, and 10 are diagrammatic representations of the preferred embodiment of FIG. 4, illustrating the operation of the embodiment with respect to light rays at different angles.

DETAILED DESCRIPTION

Figure 5:
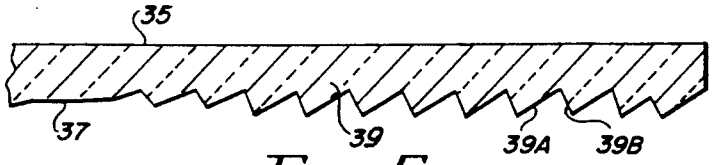
FIGS. 5 and 6 are enlarged cross-sectional portions of the embodiment shown in FIG. 4.

Reference now should be made to the drawings, in which the same reference numbers are used throughout the different figures to designate the same components.

FIG. 1 is an illustration of a typical louver assembly 20 or the type which is in widespread use in commercial fluorescent lamp fixtures. Typically, such a louver assembly comprises several longitudinal louver blades 21 interconnected by transverse louver blades 23 to form a network of rectangular or square open box-like apertures in the louver assembly. This assembly then is placed in the light emitting opening of a luminaire beneath the fluorescent bulbs to eliminate glare at high viewing angles, and to direct the light generally downwardly to the region located beneath the luminaire.

FIGS. 2 and 3 are diagrammatic illustrations of a cross section of the longitudinal blades 21 of the louver assembly 20 illustrating the operation of the assembly in conjunction with a typical fluorescent tube 25 located within the luminaire with which the louver assembly 20 is used. The cross sections of the louver blades 21 and 23 may be in the form of inverted isosceles triangles with straight sides, or the blades 21 and 23 may have concave surfaces. The louver blades 21 and 23 are made of reflective metal or other suitable material, and intercept light rays traveling at a high angle from nadir, and redirect such rays to lower angles. Such a ray 27 is illustrated in FIG. 2. Rays, such as the ray 26, emitted at lower angles, pass freely through the apertures between the louver blades 21 and 23 to usefully light objects located below the fixture.

In FIG. 3, a dotted line 28 is shown extending from the top edge of the blade 21 on one side of a louver aperture, and the lower edge of the opposite blade 21. This line also is shown intersecting a horizontal line 29; and the angle between these two lines is known in the commercial trade as the "shielding angle" If a viewer looks up at the lighting fixture such that his line or sight makes a greater angle to horizontal than the shielding angle the viewer has a clear view of the bright fluorescent light source 25, and other electrical and hardware items within the fixture with which the louver 20 is used. This is true of any standard louver fixture. To minimize the possibility of this occurring, the approach typically is to space the louver blades 21 closer together, thereby increasing the "shielding angle" between the lines 28 and 29.

FIG. 4 is a cross-sectional view of the edge portion of a typical luminaire incorporating a preferred embodiment of this invention. Fluorescent light luminaires or troffers generally are in the form of elongated rectangular boxes, which have one or more fluorescent tubes 25 mounted in them. These boxes are generally painted white on the interior, or may be made of specular materials to reflect light rays emitted from the lamp 25 onto the interior surfaces of the luminaire, such as the surfaces 30 and 31, back downwardly to the open or bottom side of the luminaire for illuminating the region located beneath the fixture. As illustrated in FIG. 4, a typical louver assembly 20, of the type illustrated in FIG. 1, is mounted in the light-emitting opening of the luminaire in a conventional manner (not shown). The cross sectional view of the fixture, as illustrated in FIG. 4, is taken across the longitudinally extending louver blades 21. These blades extend parallel to the longitudinal axis of the fluorescent light tube 25, which also is mounted within the fixture in a conventional manner (not shown). One or more parallel fluorescent tubes 25 may be mounted in the fixture. Typically, two to four fluorescent tubes 25 are used in such fixtures.

In accordance with a preferred embodiment of this invention the louver fixture which is illustrated is modified by placing =transparent refractive lens 35 on top of the louver assembly 20 between the fluorescent tube 25 located within the luminaire and the louver assembly 20. The transparent refractive lens 35 typically is formed from a single sheet of material such as acrylic plastic or glass, and is flat on the upper surface facing the lamps 25 in the luminaire. The lower surface of the lens 35 is configured specifically to refract and direct the light emanating from the lamps 25 downwardly into the apertures between the louver blades 21 and 23 prior to the light striking the blades; so that more light at nadir and low angles exits through the apertures between the longitudinal and transverse blades 21 and 23 of the louver. Much improved appearance results, even when the fixture is viewed by an observer at angles greater than the shielding angle of the louver assembly. The lens 35 is selected to give a uniformity of appearance of the louver blades themselves, and of the light emitted from the fixture. At the same time, the lens 35 "hides" the lamp 25 and internal mechanical and electrical features of the luminaire from view.

Figure 6:
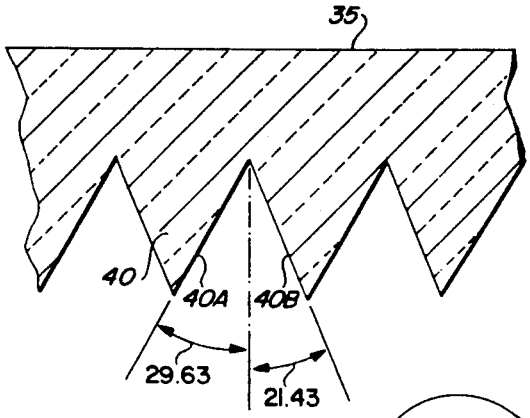
Figure 7:
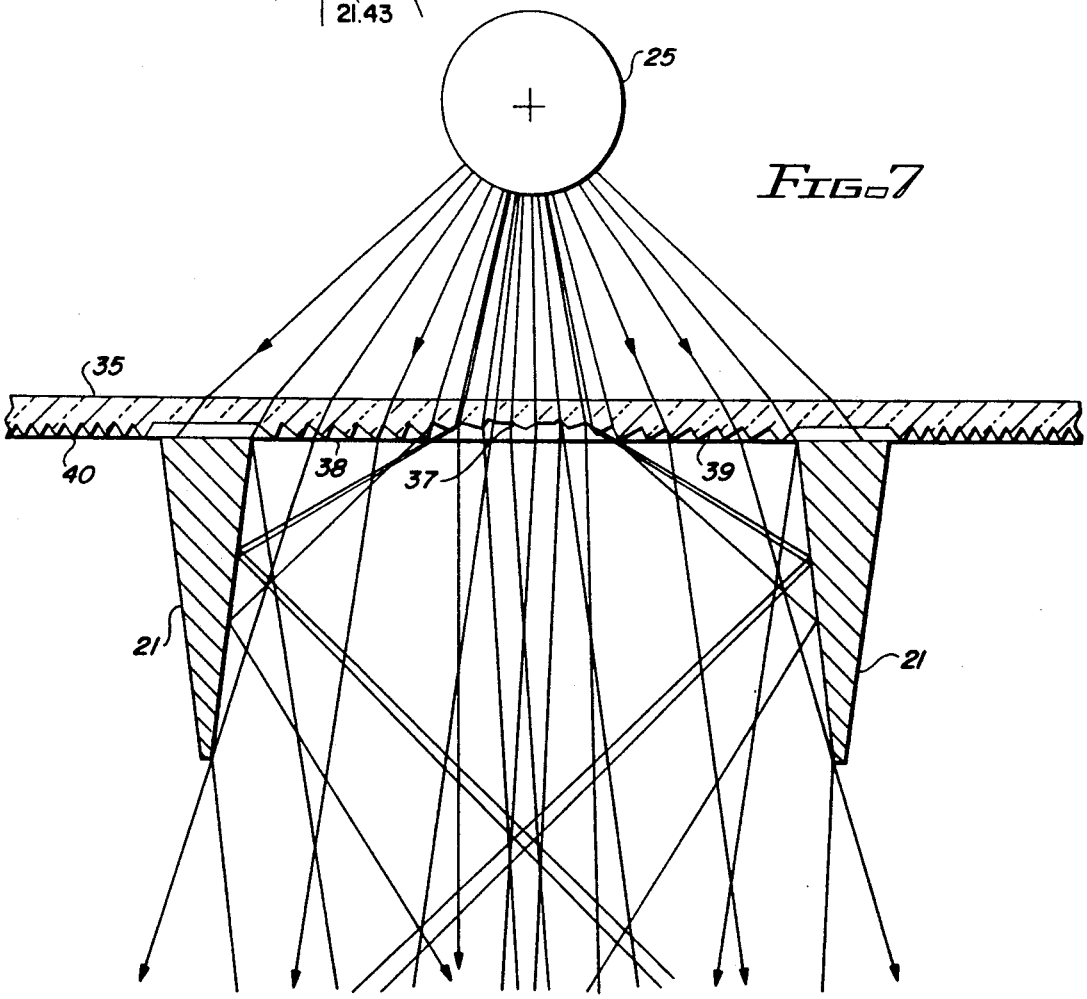

The manner in which the lens 35 is constructed to accomplish the purposes described above is illustrated in the transverse cross section shown in FIG. 4, and in greater detail in FIGS. 5 and 6 of the drawings. Directly beneath the lamps 25 in the fixture, the lower surface of the lens, in an area 37, has shallow lengthwise flutes, with an apex in the center of this region 37, formed in it. As illustrated in the light ray diagram of FIG. 7, this region tends to spread slightly and direct generally downwardly, light rays passing from the center of the lamp 25 onto this region.

Immediately adjacent the center region 37, and extending to the right and to the left of this region to the oppositely located longitudinal louver blades 21 on each side of the aperture defined by these blades, are mirror image linear prisms 38 and 39. These prisms are symmetrical about the center line of the louver apertures located directly beneath the center line of the lamp 25 and direct the rays emanating from the center of the lamp 25 substantially downwardly in accordance with a pattern shown most clearly in FIG. 7. The lens 35 intercepts light rays from the lamp 25 and directs most of them in a manner such that they do not strike the sides of the blades 21, and therefore pass directly beneath the fixture into the space to be illuminated below it. Some of the light rays at the wider angles from nadir are refracted by the lens 35, and then are reflected from the sides of the louver blades, as illustrated.

In FIG. 5 the region 39 is shown in enlarged detail (the region 38 is a mirror image of that which is illustrated in FIG. 5). The arrangement of the prisms is selected to minimize internal reflections, and to provide sufficient refraction of the light rays passing through the lens 35 to prevent as many as possible of these light rays from striking the nearly vertical surfaces of the louver blades 21. For the central sections, located beneath the lamps 25, and including the portions 37, 38, and 39, the right and left prism surfaces on the lower side of the lens 35 (38, and 39) are selected with an asymmetrical configuration, best shown in FIG. 5. The surface 39A of each of the linear prisms forming the prism area 39 is selected to be substantially perpendicular to the light rays entering the lens 35 from the center of the lamp 25 after they are refracted at the upper surface. This means that these light rays pass through the prisms essentially unrefracted a second time as they pass out of the surface 39A. The surfaces 39B are selected to be as close as possible to parallel to the steepest angles of the rays passing through the lens 35 to ensure that there are no unwanted total internal reflections of the light rays emanating from the lamp 25.

Figure 8:
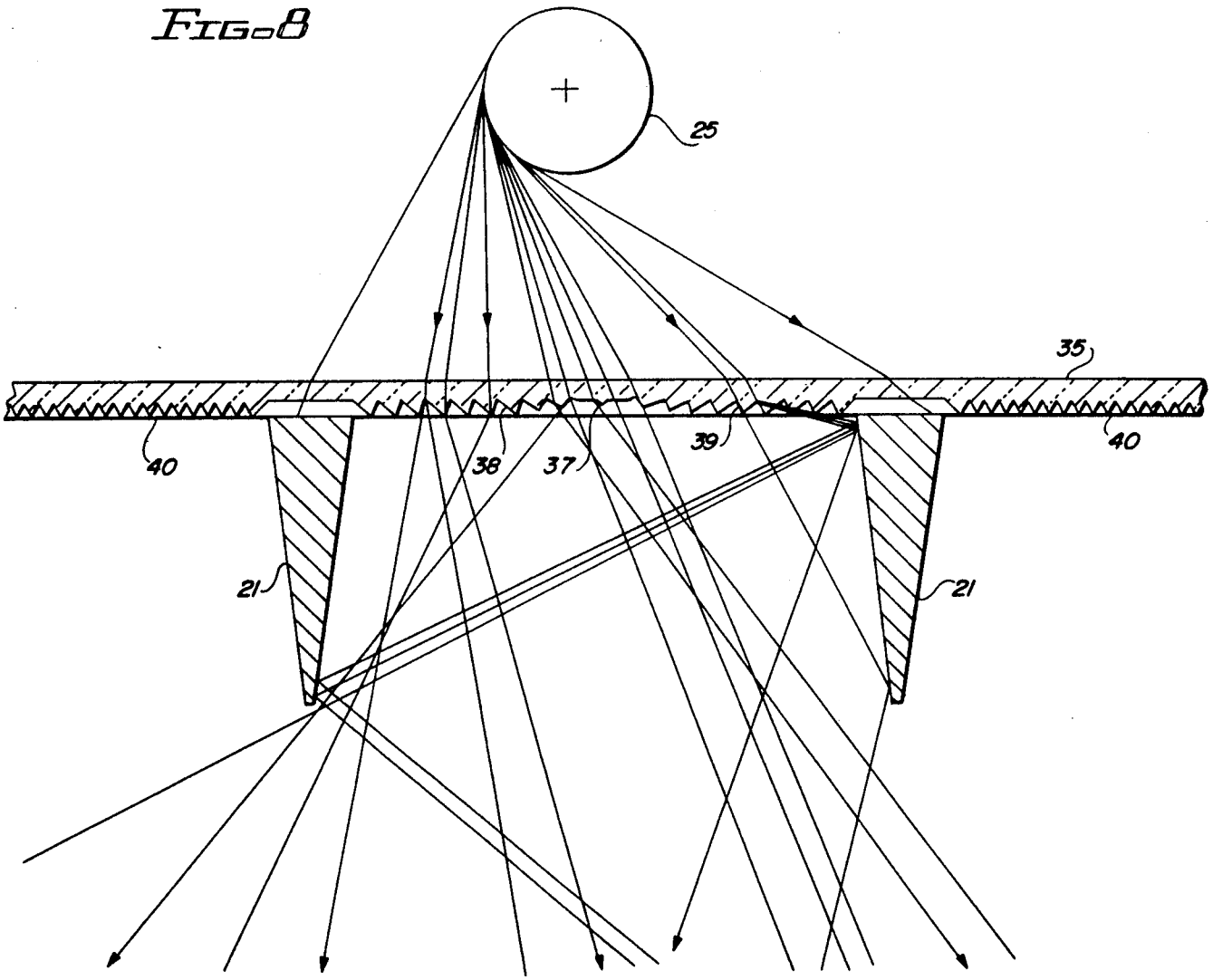

FIG. 8 illustrates the operation of the section of the linear prisms 37, 38, and 39 for light rays emanating tangentially from the surface of the elongated fluorescent lamp tube 25. Representative light rays have been illustrated, and once again, it can be seen that the large bulk of these light rays are directed generally downwardly to the area beneath the apertures formed by opposite pairs of the louver blades 21, with only a minimum number of such light rays striking the surfaces of the louver blades 21 Again, the graduated angles of the faces of the linear prisms 38 and 39 contribute to this taking place.

FIG. 6 is a detailed cross-sectional portion of the linear prisms 40, which are located in regions of the luminaire located over apertures in the louver assembly which do not have a lamp 25 located directly above them. These prisms 40 are substantially inverted isosceles triangles in cross section, but with slightly different angles for the surfaces on opposite sides of a vertical center line passing between adjacent prisms. Thus, the surface 40A, in FIG. 6, extends downwardly from such a vertical line at an angle of 29.63°, while the surface 40B extends downwardly at an angle of 21.43°. These angles have been selected for prisms 40 located over apertures in the louver 20 to the right of a lamp 25. The angular relationship for the prisms 40 located to the left of a lamp 25, such as the region 40 of the lens 35 shown on the left hand side of FIG. 4, have a reverse angular relationship to the one shown in FIG. 6. This angular relationship has been found to produce good results for a luminaire in which the center of the lamp 25 is located 1.33 inches above the upper surface of the lens 35, and in which the aperture size of the louver assembly is a 3" by 3" square, with the vertical width or depth of the louver blades 21 and 23 selected as 1.5". Clearly, modification of the specific angles of prisms 40 for particular luminaires having different physical configurations may be made.

It has been found that the graduated prisms of the type used for the prisms 38 and 39 do not need to be used for the prisms 40, since the incident angles of the light rays striking the region 40 are quite high. The prisms 40, as illustrated in FIGS. 9 and 10, are selected to divert the maximum amount of light emanating from the lamps 25, and striking the upper surface of the lens 35 directly downwardly into the spaces between adjacent louver blades 21 without striking the surfaces of the blades. This achieves a uniformity of appearance of the top opening of the louver apertures, and obscures the appearance of the lamps. Generally, even spreading of the light over the entire surface of the lens 35 is obtained. The light pattern from the prisms is selected to be as close to identical as possible for each of the prisms 37, 38, 39, and 40. This ensures the appearance of uniform brightness from any point by an observer located below the fixture, and observing the fixture at an angle greater than the shielding angle.

The control of the light rays emanating from the fluorescent lamps 25 and passing through the lens 35 and louver assembly 20 primarily is directed to directions transverse to the axes of the lamps in the luminaire. This is the region in which the greatest amount of potential glare from the luminaire takes place. While dispersion of light rays along the longitudinal axis of the lamps 25 also takes place, this is not a significant problem. By generating approximately equivalent light distribution patterns at every point across the luminaire, the lens 35 becomes the apparent source of light to an observer, and it appears essentially uniform in its brightness. Consequently, a major objection to louvers, that is non-uniform brightness and exposure of the fixture interior, is removed.

If all that were to be achieved is a generally uniform light distribution at the top of the apertures in the louvers commercially available diffusers overlaid on the louver can accomplish this. Diffusers, however, create a substantial scattering of the light, and much light then strikes the sides of the louver blades and is partially absorbed. As mentioned previously, the reflection of some of this light also causes scattering of some light rays at relatively high angles; so that the effect of the shielding angle provided by a louver alone is minimized, and the shielding effect is diminished. In addition, diffusers overlaid on a louver do not narrow the light pattern as in the case of the lens 35 described above; so that, again, high angle rays could strike a VDU located beneath a fixture to cause undesirable light reflections from the VDU screen. The lens 35, by directing light rays passing between the louver blades downwardly at angles close to nadir, provides an ideal working environment when fixtures of the type described above are used in rooms in which VDU's are operated.

Without the presence of the louver assembly 20, the lens 35 provides a significant concentrating distribution of light directed generally downwardly from the luminaire. However, due to manufacturing imperfections, optical limitations, and light received from secondary sources other than the lamps 25 (for example, the white painted inner surface of the luminaire), lenses used, for example, in fluorescent fixtures always possess some brightness at high angles of view. These are the glare angles. The synergistic combination of the lens 35 and the louver assembly 20 remove this high angle brightness, since it is shielded by the louver 20. The net result is a combination which has no glare and close to total darkness at normal viewing angles. At the same time, the fixture, when it is viewed from below, exhibits a uniform and aesthetically desirable appearance.

Energy efficiency has not been sacrificed to meet these goals. This has been verified in two tests of an identical fixture. In both of these tests, a commercially available 2' by 4' fluorescent luminaire with a 78 aperture, 3" by 3" by 1.5" semi-specular parabolic louver, was employed. Two F40T12/CW fluorescent lamps were used. The lamps had a lumen rating of 3150 LMS. The fixture included one Advance R-2S40-1-TP fluorescent lamp ballast. This fixture can be considered to be a standard fluorescent light/louver combination. Table I below is a candlepower summary taken at different angles (left hand column), along (longitudinally), at 22.5°, 45°, 67.5° and across (transversely or 90° to the bulb axis). The candlepower summary and the output lumens for each of these angles is shown.

TABLE I

| | CANDLEPOWER SUMMARY | | | | | |
|---|---|---|---|---|---|---|
| ANGLE | ALONG | 22.5° | 45° | 67.5° | ACROSS | OUTPUT LUMENS |
| 0 | 1467 | 1467 | 1467 | 1467 | 1467 | |
| 5 | 1468 | 1461 | 1472 | 1481 | 1481 | 141 |
| 10 | 1445 | 1449 | 1480 | 1510 | 1520 | |
| 15 | 1402 | 1425 | 1484 | 1538 | 1560 | 419 |
| 20 | 1345 | 1388 | 1479 | 1559 | 1572 | |
| 25 | 1285 | 1347 | 1461 | 1509 | 1520 | 658 |
| 30 | 1210 | 1294 | 1397 | 1414 | 1431 | |
| 35 | 1122 | 1232 | 1299 | 1304 | 1323 | 791 |
| 40 | 1020 | 1149 | 1170 | 1173 | 1194 | |
| 45 | 900 | 1034 | 1034 | 1012 | 1029 | 787 |
| 50 | 768 | 885 | 881 | 914 | 1029 | |
| 55 | 617 | 710 | 723 | 915 | 1042 | 682 |
| 60 | 422 | 475 | 539 | 665 | 669 | |
| 65 | 101 | 156 | 229 | 153 | 115 | 228 |
| 70 | 33 | 34 | 49 | 36 | 38 | |
| 75 | 15 | 16 | 20 | 17 | 22 | 22 |
| 80 | 7 | 7 | 9 | 8 | 10 | |
| 85 | 4 | 5 | 6 | 5 | 4 | 5 |
| 90 | 0 | 0 | 0 | 0 | 0 | |

The same identical fixture used for the test shown in Table I was then used for the test shown in Table II; but the fixture was modified to provide a lens overlay of the type described above for lens 35. Table II below shows the significant large increase in downward candlepower (about 40% more light in the low angle regions), with a large decrease in high angle light, in the 55° to 70° regions.

TABLE II

| | CANDLEPOWER SUMMARY | | | | | |
|---|---|---|---|---|---|---|
| ANGLE | ALONG | 22.5° | 45° | 67.5° | ACROSS | OUTPUT LUMENS |
| 0 | 2069 | 2069 | 2069 | 2069 | 2069 | |
| 5 | 2102 | 2070 | 2073 | 2055 | 2059 | 197 |
| 10 | 2081 | 2046 | 2046 | 2045 | 2035 | |
| 15 | 2025 | 2004 | 2008 | 2000 | 1988 | 565 |
| 20 | 1954 | 1932 | 1924 | 1904 | 1898 | |
| 25 | 1868 | 1841 | 1787 | 1770 | 1765 | 821 |
| 30 | 1750 | 1695 | 1579 | 1434 | 1376 | |
| 35 | 1607 | 1474 | 1167 | 1019 | 997 | 794 |
| 40 | 1399 | 1154 | 913 | 849 | 853 | |
| 45 | 1133 | 903 | 767 | 698 | 699 | 643 |
| 50 | 862 | 720 | 643 | 582 | 601 | |
| 55 | 643 | 550 | 491 | 479 | 528 | 463 |
| 60 | 384 | 348 | 321 | 336 | 362 | |
| 65 | 96 | 120 | 121 | 85 | 52 | 141 |
| 70 | 30 | 25 | 27 | 16 | 28 | |
| 75 | 14 | 7 | 11 | 11 | 17 | 14 |
| 80 | 1 | 3 | 16 | 3 | 6 | |
| 85 | 6 | 4 | 5 | 1 | 1 | 4 |

TABLE II-continued

| | CANDLEPOWER SUMMARY | | | | | |
|---|---|---|---|---|---|---|
| ANGLE | ALONG | 22.5° | 45° | 67.5° | ACROSS | OUTPUT LUMENS |
| 90 | 0 | 0 | 0 | 0 | 0 | |

Both of the tests of Table I and Table II above were run according to identical IES procedures. The test distance was 7.9 meters (26.0 feet). The center to center distance between adjacent prisms 40 was 0.0921." and the center to center spacing of the prisms 38 and 39 was 0.1226".

In addition, when luminaires of the type described above and shown in FIGS. 4 through 10 are placed in a room to provide overall lighting, a substantial increase in the visual comfort rating for all sizes of rooms has been realized. A significant synergism between the combination of the lens 35 and the louver assembly 20 takes place. The fixture which has been disclosed has substantial utility in modern office environments.

Various changes and modifications will occur to those skilled in the art without departing from the true scope of the invention. For example, the lens 35 need not be formed from extruded acrylic plastic. The lens can be molded from glass or plastic, or formed by other suitable techniques. Also, the specific angular configurations and spacings of the prisms which have been described have been tailored to the particular working model of the preferred embodiment, and may be varied to fit luminaires having different dimensions and configurations from the one which has been described. The principles of the operation of the invention remain the same, even though some of the specific angles of the prisms may be varied to fit a particular working environment in which the invention is to be used. Other changes and modifications will occur to those skilled in the art, without departing from the true scope of the invention as defined in the appended claims.

We claim:

1. A light-shielding and light-directing apparatus for placement in the light-emitting opening of a luminaire having a source of light therein, said apparatus including in combination a louver assembly for mounting in the light-emitting opening of the luminaire, and comprising at least a plurality or longitudinal louvers dividing the light-emitting opening into a plurality of rectangular apertures, each of said longitudinal louvers having a predetermined depth in a plane perpendicular to the plane of the light-emitting opening in the luminaire; and lens means located in the luminaire between said louver assembly light rays from the source of light in the luminaire, and directing such intercepted light downwardly through said apertures at angles select to substantially minimize amount of light which strikes said louvers.

2. The combination according to claim 1 wherein said lens means is made of transparent material.

3. The combination according to claim 2 wherein said lens means is made of acrylic plastic.

4. The combination according to claim 3 wherein said lens means is formed from a single sheet of plastic material.

5. The combination according to claim 4 wherein said lens means is formed of a single sheet of transparent material, which is flat on the surface facing the source of light in the luminaire, and which has prisms formed on the lower surface thereof facing said louver assembly to redirect light rays passing through said lens means into said apertures between said louvers.

6. The combination according to claim 5 wherein said lower surface of said lens means is formed into a plurality of parallel linear prisms extending parallel to said longitudinal louvers.

7. The combination according to claim 6 wherein said prisms are formed at varying angles with respect to the flat upper surface of said lens means, with said angles determined by the location of said prisms relative to the light source within the luminaire.

8. The combination according to claim 7 wherein the light source within the luminaire is an elongated fluorescent tube with said longitudinal louvers extending parallel to said tube.

9. The combination according to claim 8 wherein said predetermined depth of said louvers is between one-half inch and four inches.

10. The combination according to claim 9 wherein said louver assembly further has a plurality of transverse louvers intersecting said longitudinal louvers.

11. The combination according to claim 1 wherein said louver assembly further has a plurality of transverse louvers intersecting said longitudinal louvers.

12. The combination according to claim 11 wherein said lens means is made of transparent material.

13. The combination according to claim 12 wherein said lens means is formed of a single sheet of transparent material, which is flat on the surface facing the source of light in the luminaire, and which has prisms formed on the lower surface thereof facing said louver assembly to redirect light rays passing through said lens means into said apertures between said louvers.

14. The combination according to claim 13 wherein said lower surface of said lens means is formed into a plurality of parallel linear prisms extending parallel to said longitudinal louvers.

15. The combination according to claim 1 wherein said lens means is formed of a single sheet of transparent material, which is flat on the surface facing the source of light in the luminaire, and which has prisms formed on the lower surface thereof facing said louver assembly to redirect light rays passing through said lens means into said apertures between said louvers.

16. The combination according to claim 15 wherein said prisms are longitudinal prisms extending parallel to said longitudinal louvers.

17. The combination according to claim 16 wherein said lens means is made of acrylic plastic.

18. The combination according to claim 1 wherein said lens means is formed from a single sheet of plastic material.

19. The combination according to claim 1 wherein the light source within the luminaire is an elongated fluorescent tube with said longitudinal louvers extending parallel to said tube.

* * * * *